US005968720A

United States Patent [19]

Faranda et al.

[11] Patent Number: 5,968,720

[45] Date of Patent: Oct. 19, 1999

[54] PHOTOGRAPHIC FIXER COMPOSITIONS AND METHOD FOR PROCESSING A PHOTOGRAPHIC ELEMENT

[75] Inventors: Filippo Faranda, Savona; Franco Buriano, Carcare; Carlo Marchesano, Savona, all of Italy

[73] Assignee: Imation Corp, Oakdale, Minn.

[21] Appl. No.: 08/679,745

[22] Filed: Jul. 15, 1996

Related U.S. Application Data

[63] Continuation of application No. 08/539,728, Oct. 5, 1995, abandoned.

[30] Foreign Application Priority Data

Nov. 8, 1994 [EP] European Pat. Off. ..... 94117588

[51] Int. Cl.[6] ..... G03C 5/38

[52] U.S. Cl. ..... 430/455; 430/451; 430/453

[58] Field of Search ..... 430/451, 453, 430/455

[56] References Cited

U.S. PATENT DOCUMENTS

| | | | |
|---|---|---|---|
| 3,994,729 | 11/1976 | Shibaoka | 430/453 |
| 4,963,474 | 10/1990 | Fujita et al. | 430/455 |
| 5,217,853 | 6/1993 | Yamada et al. | 430/451 |
| 5,272,046 | 12/1993 | Sasaka | 430/455 |
| 5,288,595 | 2/1994 | Watanabe et al. | 430/455 |
| 5,298,373 | 3/1994 | Sasaka et al. | 430/455 |
| 5,338,648 | 8/1994 | Kojima et al. | 430/455 |
| 5,415,983 | 5/1995 | Kojima et al. | 430/455 |

FOREIGN PATENT DOCUMENTS

| | | | |
|---|---|---|---|
| 5323525 | 12/1993 | Japan | 430/455 |

OTHER PUBLICATIONS

CA 120–22–284859f.

"Hardening Fix Baths for Use in Photographic Processing," Research Disclosure, Nov., 1979, No. 18728, p. 625.

*Primary Examiner*—Hoa Van Le

*Attorney, Agent, or Firm*—Gregory A. Evearitt; Mark A. Litman

[57] ABSTRACT

A photographic fixer compositions comprising a silver halide solvent, an aluminum salt hardening agent, a buffering agent and ammonium ions in amount of at least 0.20 mol/l, wherein said fixer composition also contains at least an aminopolycarboxylic acid sequestering agent of formula (I-a) or (I-b) or a water-soluble salt thereof and d) at least a polyphosphonic acid sequestering agent of formula (II-a), (II-b), (II-c), (II-d') or (II-d"):

(I-a)

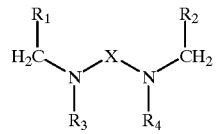

(I-b)

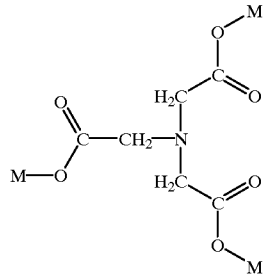

(II-a)

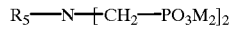

(II-b)

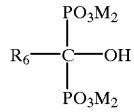

(II-c)

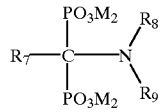

(II-d')

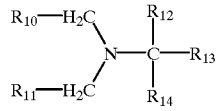

or (II-d")

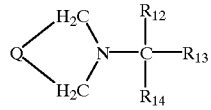

wherein the substituents are defined in the specification.

The present invention also provides a method of processing an exposed photographic silver halide element comprising the steps of developing by means of a developer comprising a silver halide developing agent and treating the developed element with a fixer composition, wherein the fixer composition is one described above.

14 Claims, No Drawings

PHOTOGRAPHIC FIXER COMPOSITIONS AND METHOD FOR PROCESSING A PHOTOGRAPHIC ELEMENT

This is a continuation of application Ser. No. 08/539,728, filed Oct. 5, 1995, now abandoned.

BACKGROUND OF THE INVENTION

In processing photographic films, especially X-ray films, it is highly advantageous to complete the processing in a very short period of time. To accomplish this objective, it is common practice to process such films using a roller transport processor and to carry out the processing without an intervening washing step between the steps of developing and fixing. This method of processing is described, for example, in U.S. Pat. No. 3,545,971. To facilitate the use of a roller transport processor, both the developer and the fixer typically contain a hardening agent, with the hardening agent usually being an aldehyde in the developer and an aluminum salt in the fixer. Boric acid is often incorporated in the fixer used in the aforesaid process to prevent the formation of sludge resulting from precipitation of aluminum hydroxide when the fixer is contaminated by developer carry-in. Such use of boric acid is described, for example, in U.S. Pat. No. 4,046,570. The hardening fixer composition described in this patent also contains a 1-hydroxy-alkylidene diphosphonic acid, in which the alkylidene group contains from 2 to 5 carbon atoms to retard formation of aluminum hydroxide. The 1-hydroxy-alkylidene diphosphonic acid partially or completely replace boric acid in the hardening fixer composition.

Another method to reduce the precipitation of aluminum hydroxide has been described in Research Disclosure 17549, wherein a combination of a diphosphonic acid, such as a hydroxyalkylidene diphosphonic acid, and an aminopolycarboxylic acid, such as a 1,3-diamino-2-propanol tetraacetic acid, has the tendency for aluminum hydroxyde precipitates, as a result of carrying of aluminum salt hardening agent contacting in the hardening baths. The diphosphonic acid and the aminopolycarboxylic acid are effective in the stabilizing bath in small concentrations such as amounts of each of about one gram per liter or less. The pH of said color stabilizing bath is in the range from about 6 to about 11.

Japanese Patent Application 05-323,525 describes a black-and-white fixer solution comprising aminopolycarboxylic acids and/or phosphonic acids as chelating agent, preventing the water fur and odour. The fixer composition is substantially free of ammonium ions and substantially free of aluminum hardener, the amount of the hardener being lower than 0.01 mol/l that is the minimum amount known in the art to give the fixer composition a hardening activity, as described in Research Disclosure 16768 and in U.S. Pat. No. 4,046,570.

To further promote the objective of a very short total processing time, it is advantageous to employ ammonium thiosulfate as the fixing agent, because it acts more rapidly than alternative fixing agents such as sodium thiosulfate, as described in GB 1,290,026. Thus, a particularly desirable fixer is one which contains ammonium thiosulfate and is free of boric acid; however, it has been found that a very serious problem of crystal formation occurs. In particular, crystals are deposited from the fixer on the walls of the fixer tank and on the roller assemblies. In addition, the crystalline deposit displays a tendency to absorb additional fixer, thereby resulting in movement of "creep" along processor parts and tank walls. Research Disclosure 18728 discloses a number of agents incorporated in the hardening fixer and which suppress crystal formation. Useful agents are, for example, aminopolyphosphonic acids, such as diethylenetriaminepentamethylenephosphonic acid, and aminopolycarboxylic acids, such as 1,3-diamino-2-propanol tetraacetic acid.

EP 486,909 describes ammonium-free fixing bath containing a complex building agent, e.g., nitrilodiacetic monopropionic acid, useful for silver halide photographic materials. The baths exhibit good fixing speed and no deposition.

The pH of these fixer baths is normally around 4.00–4.30, because at higher pH, expecially more than 5.00, there is precipitation of $Al(OH)_3$. On the other hand, lower pH is correlated with high $SO_2$ evolution, which is environmentally dangerous. It could be useful to have a photographic fixer composition showing a reduced tendency to form an aluminum hydroxyde precipitation at pH values higher than those of standard fixer compositions. In fact, a fixer composition working at said high pH value could be also advantageous from an environmental point of view, showing a reduced $SO_2$ emission.

SUMMARY OF THE INVENTION

A photographic fixer composition is described in the present invention, said composition comprising a silver halide solvent, an aluminum salt hardening agent, a buffering agent and ammonium ions in amount of at least 0.20 mol/l, at least an aminopolycarboxylic acid sequestering agent of formula (I-a) or (I-b) or a water-soluble salt thereof and at least a polyphosphonic acid sequestering agent of formula (II-a), (II-b), (II-c), (II-d') or (I-d"):

(I-a)

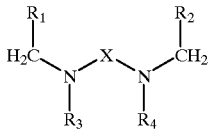

(I-b)

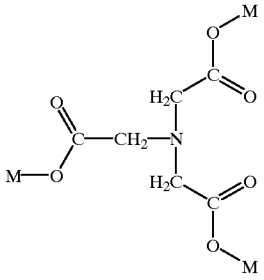

wherein X is an unsubstituted alkylene group having 1 to 4 carbon atoms; $R_3$ and $R_4$, equal or different, each represent hydrogen or —$CH_2$—$R_1$ and $R_1$ and $R_2$, equal or different, each represent —COOM, wherein M represents a hydrogen atom, a sodium atom, a potassium atom, a lithium atom or a quaternary ammonium group (such as ammonium, pyridinium, triethanolammonium or triethylammonium);

(II-a)

wherein M is as above and $R_5$ is an alkyl group, an aryl group, an aralkyl group, an alkaryl group, an alicyclic group or a heterocyclic radical, and $R_5$ can be further substituted with substituents suchs as hydroxyl, halogen, an alkoxy group, a —$PO_3M_2$ group, a —$CH_2PO_3M_2$ group, or an —N—$(CH_2PO_3M_2)_2$ group;

(II-b)

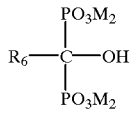

wherein M is as above and $R_6$ is an alkyl group, preferably of one to five carbon atoms, (II-c)

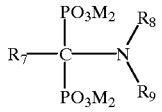

wherein M is as above and $R_7$, $R_8$ and $R_9$ are hydrogen or an alkyl group, preferably alkyl of one to five carbon atoms, and (II-d')

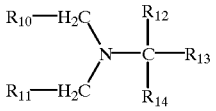

or (II-d")

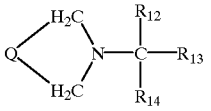

wherein $R_{12}$, $R_{13}$ and $R_{14}$, equal or different, each represent a hydrogen atom or a —$PO_3M_2$ group, wherein M has the same meaning of above, and $R_{10}$ and $R_{11}$, equal or different, each represent a hydrogen atom, an alkyl group, a —$PO_3M_2$ group or a $PO_3M_2$ substituted alkyl group, and Q represents the atoms or chemical bonds necessary to complete a 3- to 6-membered ring, with the proviso that at least two of $R_{10}$, $R_{11}$, $R_{12}$, $R_{13}$ and $R_{14}$ substituents represent a —$PO_3M_2$ group.

The present invention also provides a method of processing an exposed photographic silver halide element comprising the steps of developing by means of a developer comprising a silver halide developing agent and treating the developed element with a fixer composition, wherein the fixer composition is one described above.

The photographic fixer composition of the present invention shows a reduced tendency to form an aluminum hydroxyde precipitation than standard fixer compositions; in addition, the fixer composition of the present invention shows a reduced $SO_2$ emission because it is able to work well at pH values higher than standard values.

DETAILED DESCRIPTION OF THE INVENTION

The hardening agent contained in the photographic fixer composition of the present invention is an aluminum salt hardening agent; it is of the kind generally used in acid hardening fixers which include soluble aluminum salts or complexes like aluminum chloride, aluminum sulfate and potassium or ammonium alum. The amount of aluminum salt hardening agent is dependent on the desired hardening effect which depends on the particular photographic element to be processed and prehardening stages e.g., possible development by means of a developing solution containing hardening agents e.g., dialdehyde hardeners as represented by glutaraldehyde or its bisulfite addition product. Generally the amount of aluminum salt hardening agent is at least 0.01 mol per liter, and preferably between about 0.02 mol and about 0.2 mol per liter.

The photographic fixer composition comprises as silver halide solvent a thiosulfate or thiocyanate, thiosulfate being preferred, e.g., ammonium thiosulfate, sodium thiosulfate, potassium thiosulfate and the like, as described in U.S. Pat. No. 3,582,322. The amount of silver halide solvent is generally in the range from about 0.5 to about 2.5 mol per liter.

Buffering agents are, for example, sodium acetate, sodium citrate and ammonium acetate; the preferred buffering agent is ammonium acetate. The amount of ammonium ions contained in the fixer composition is of at least about 0.20 mol/l, preferably at least 0.30 mol/l.

In the previous formulas (I-a) and (I-b), representing aminopolycarboxylic acids as sequestering agents, X is a unsubstituted alkylene group having 1 to 4 carbon atoms, such as an ethylene or a propylene group. Water-soluble salts of aminopolycarboxylic acid compounds are, for example, sodium, potassium, pyridinium, triethanolammonium and triethylammonium salts. Useful examples of aminopolycarboxylic acids represented by formulas (I-a) and (I-b) are:

(I-1)

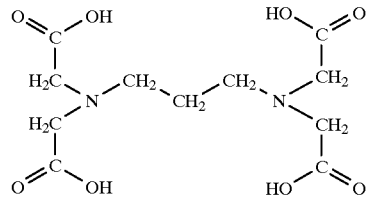

(I-2)

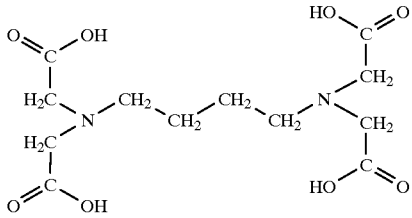

(I-3)

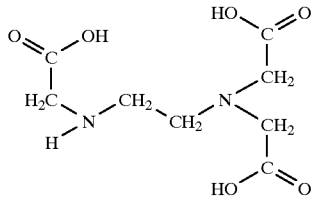

-continued (I-4)

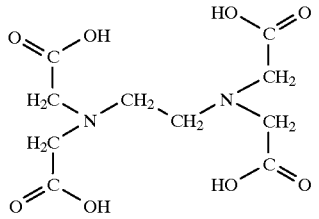

(I-5)

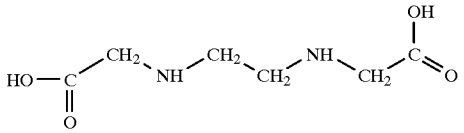

(I-6)

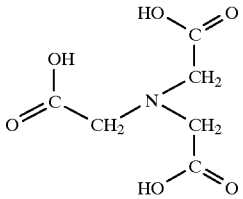

The polyphosphonic acid sequestering agents of formulas (II-a), (II-b), (II-c), (II-d') and (II-d") have been described in EP 286,874 and in Research Disclosure 18837. $R_5$ in the formula (II-a) can be an alkyl group, having 1 to 5 carbon atoms (e.g., methyl, ethyl, n-propyl, isopropyl, n-butyl, n-pentyl, etc.), an aryl group having from 6 to 20 carbon atoms (e.g., phenyl, naphthyl, etc.), an aralkyl group having from 6 to 20 carbon atoms (e.g., benzyl, phenethyl, etc.), an alkaryl group, an alicyclic group or a heterocyclic radical, and $R_5$ can be further substituted with substituents suchs as hydroxyl, halogen (e.g. chloro, bromo), alkoxy groups having 1 to 20 carbon atoms (e.g., methoxy, ethoxy, 2-methylpropyloxy, etc.). $R_6$ in the formula (II-b) can be an alkyl group, having 1 to 5 carbon atoms (e.g., methyl, ethyl, n-propyl, isopropyl, n-butyl, n-pentyl, etc.); $R_7$, $R_8$ and $R_9$ in the formula (II-c) can be hydrogen or alkyl groups having 1 to 5 carbon atoms (e.g., methyl, ethyl, n-propyl, isopropyl, n-butyl, n-pentyl, etc.). In the formula (II-d'), the dialkylamino group preferably includes alkyl groups having from 1 to 5 carbon atoms, e.g., dimethylamino, diethylamino, dipropylamino, dibutylamino, N-methyl-N-propylamino, etc. In the formula (II-d"), the cyclicamino group preferably represents a 3- to 6-membered ring e.g., aziridino, pyrrolidino, imidazolidino, piperidino, piperazino, isoindolino, morpholino, etc. Suitable substituents of said dialkylamino and cyclicamino groups include an alkyl group, preferably a lower alkyl group having 1 to 4 carbon atoms, e.g., methyl, ethyl, butyl, etc., a halogen atom, a nitro group, a cyano group, an aryl group, e.g., phenyl, naphthyl, etc., an alkoxy group, preferably a lower alkoxy group having 1 to 4 carbon atoms, e.g., methoxy, ethoxy, methoxyethoxy, etc., an aryloxy group, e.g., phenoxy, 4-hydroxyphenoxy, naphthoxy, etc., an acyloxy group, e.g., acetyloxy, benzoyl, etc., a sulfamoyl group, e.g., N-ethylsulfamoyl, etc., an acylamino group, e.g., acetylamino, benzamino, etc., a diacylamino group, e.g., succimido, hydantoinyl, etc., a ureido group, e.g., methylureido, phenylureido, etc., a sulfonamido group, e.g., methanesulfonamido, methoxyethanesulfonamido, etc., a hydroxy group, a phosphonic group, a carboxy group, an alkylcarbonyl group, e.g., acetyl, etc., an arylcarbonyl group, e.g., benzoyl, etc., an alkoxycarbonyl group, e.g., methoxycarbonyl, benzyloxycarbonyl, etc., an aryloxycarbonyl group, e.g., phenoxycarbonyl, p-tolyloxycarbonyl, etc., a carbamoyl group, e.g., N-ethylcarbamoyl, etc., a heterocyclic group, a mercapto group, an alkylthio group, an arylthio group, an alkylsulfonyl group, an arylsulfonyl group, an acyl group, or an aralkyl group.

Typical examples of sequestering agents within the general formulas (II-a), (II-b), (II-c), (II-d') or (II-d") are the following.

(II-1)

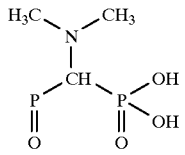

(II-2)

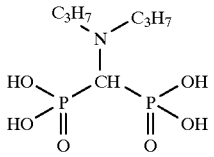

(II-3)

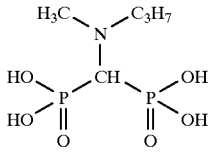

(II-4)

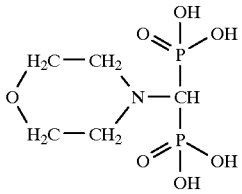

(II-5)

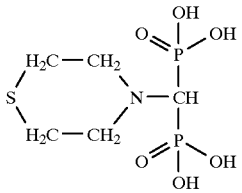

(II-6)

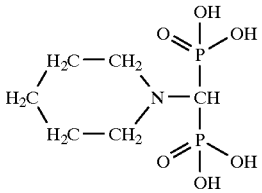

(II-7)

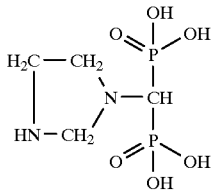

-continued (II-8)

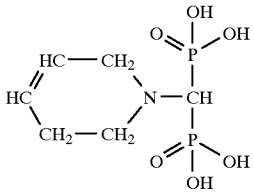

(II-9)

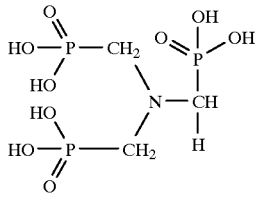

(II-10)

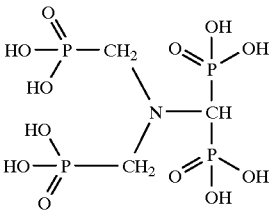

(II-11)

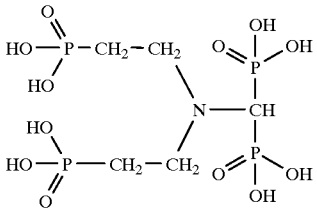

(II-12)

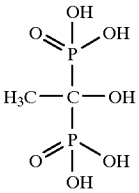

(II-13)

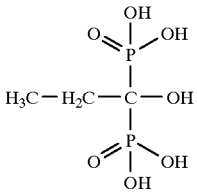

(II-14)

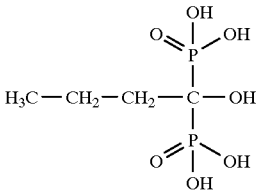

-continued (II-15)

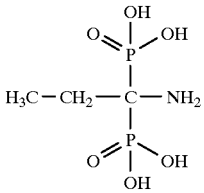

(II-16)

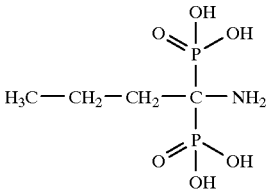

(II-17)

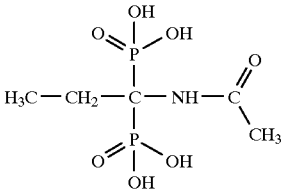

(II-18)

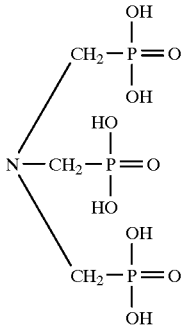

The amounts of the aminopolycarboxylic acids sequestering agent represented by formula (I-a) or (I-b) and of the polyphosphonic acids sequestering agent of formulas (II-a), (II-b), (II-c) or (II-d) depend on the amount of the aluminum hardener present in the fixer composition of the present invention. In practice, at least 0.05 mol of aminopolycarboxylic acid sequestering agent of formula (I) and at least 0.05 mol of polyphosphonic acid sequestering agent of formula (II) are needed per 10 moles of aluminum hardener, preferably at least 0.10 mol of each type of sequestering agent per 10 moles of aluminum hardener.

When the term "group" or "nucleus" is used in the present invention, the described chemical material includes the basic group or nucleus and that group or nucleus with conventional substituents. When the term "moiety" is used to decribe a chemical compound or substituent, only an unsubstituted chemical material is intended to be included. For example, "alkyl group" includes not only such alkyl moieties as methyl, ethyl, octyl, stearyl, etc. but also such moieties bearing substituents groups such as halogen, cyano, hydroxyl, nitro, amine, carboxylate, etc. On the other hand, "alkyl moiety" or "alkyl" includes only methyl, ethyl, octyl, stearyl, cyclohexyl, etc.

The fixer composition may further comprises the usual ingredients, e.g., inorganic or organic acids to obtain the required acidity which is generally in the range from about 4.00 to about 7.00, preferably from about 4.75 to about 6.25, e.g., sulfuric acid, acetic acid and citric acid, a borate, e.g., borax, sulfites, e.g. sodium sulfite and bisulfites, e.g., sodium and potassium metabisulfite, wetting agents and the like. Sulfite ions are added in an amount of at least 0.1 mol per liter.

The fixer composition of the present invention can be usually made as ready-to-use composition or as single concentrated liquid part that is then diluted with water in automatic processors by the use of a mixer, to have a ready-to-use solution. A method of making a concentrated alkaline photographic composition packaged in a single concentrated part to be diluted with water to form a ready-to-use solution is shown, for example, in U.S. Pat. No. 4,987,060.

In another aspect, the present invention refers to a process for treating an exposed photographic silver halide element comprising the steps of developing by means of an aqueous alkaline developing solution comprising a silver halide developing agent and treating the developed element with a fixer composition of the present invention.

The developing agents employed in the aqueous alkaline developing solution for use in the practice of this invention are well-known and widely used in photographic processings. Useful developing agents are chosen among the class of ascorbic acid, reductic acid and dihydroxybenzene compounds. Among the dihydroxybenzene compounds, the preferred developing agent is hydroquinone. Other useful dihydroxybenzene developing agents include chlorohydroquinone, bromohydroquinone, isopropylhydroquinone, tolylhydroquinone, methylhydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5-dibenzoylhydroquinone, 2,5-diacetaminohydroquinone.

The aqueous alkaline developing solution for use in the practice of this invention also comprises auxiliary developing agents showing a superadditive effect, as described in Mason, "Photographic Processing Chemistry", Focal Press, London, 1975.

For the purpose of the present invention, the preferred superadditive auxiliary developing agents are those described in U.S. Pat. No. 5,236,816; particularly useful are the auxiliary developing agents such as aminophenol and substituted aminophenol (e.g., N-methyl-p-aminophenol, also known as metol and 2,4-diaminophenol) and pyrazolidones (e.g., 1-phenyl-3-pyrazolidone, also known as phenidone) and substituted pyrazolidones (e.g., 1-phenyl-4-methyl-3-pyrazolidone, 1-phenyl-4-methyl-4-hydroxymethyl-3-pyrazolidone, also known as dimezone S, and 1-phenyl-4,4'-dimethyl-3-pyrazolidone, also known as dimezone).

The aqueous alkaline photographic developing solution for use in the practice of this invention contains a sulfite preservative at a level sufficient to protect the developing agents against the aerial oxidation and thereby assure good stability characteristics. Useful sulfite preservatives include sulfites, bisulfites, metabisulfites and carbonyl bisulfite adducts. Typical examples of sulfite preservatives include sodium sulfite, potassium sulfite, lithium sulfite, ammonium sulfite, sodium bisulfite, potassium metabisulfite, sodium formaldehyde bisulfite salt. Also ascorbic acid is a known preservative agent against aerial oxidation of the developer for use in the bath.

Typically, the dihydroxybenzene developing agent is used in an amount of from 0.040 to 0.70 moles per liter, more preferably in an amount of from 0.08 to about 0.40 moles per liter; the 3-pyrazolidone developing agent is used in an amount of from 0.001 to 0.05 moles per liter, more preferably in an amount of from 0.005 to 0.01 moles per liter; the sulfite preservative is used in an amount of from 0.03 to 1.0 moles per liter, more preferably in an amount of from 0.10 to 0.70 moles per liter.

In carrying out the method of this invention, it is preferred to use an organic antifogging agent to minimize fog formation in the processed element. Preferred organic antifogging agents for specific use in the developing solutions are benzotriazole and/or a benzimidazole antifogging agents, which proved to have beneficial effects on increasing contrast. Useful quantities, when they are included in the emulsion, may vary from 1 to 100 milligrams per 100 grams of emulsion and, when included in the developing bath, as preferred, may vary from 0.01 to 5 grams per liter.

In addition to the essential components specified hereinabove, the developing solutions can optionally contain any of a wide variety of addenda, as known, useful in photographic developing solutions. For example, they can contain solvents, buffers, sequestering agents, development accelerators, agents to reduce swelling of the emulsion layers, and the like.

The fixing compositions of the present invention are useful in a process for treating a silver halide photographic element which can be used for any general black and white photography, graphic arts, X-ray, print, microfilm, color reversal (i.e., in the black and white development step of a color reversal process), and the like.

In particular, useful photographic elements which can be used in this invention are silver chloride emulsion elements as conventionally employed in forming halftone, dot, and line images usually called "lith" elements. Said elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than 0.4 micrometers, more preferably lower than 0.2 micrometers. Other references to lith materials can be found in Research Disclosure 235, Item 23510, November 1983.

The fixing compositions of the present invention are also useful in a process for forming high contrast silver images by development of a photographic element including a negative acting surface latent image-type silver halide emulsion layers in reactive association with a hydrazine compound and a contrast promoting agent.

The contrast promoting agent compound can be incorporated in the photographic element or in the developing solution or both in the developing solution and in the photographic element.

Preferred contrast promoting agents, which can be incorporated in the developing solution, include hydroxymethylidine group containing compounds, such as diarylmethanol compounds, as described in U.S. Pat. No. 4,693,956. Examples of diarylmethanol contrast promoting agents are methyl alcohol, benzhydrol, 1,3-butanediol, 1,4-cyclohexanediol, phenylmethylcarbinol and the like.

Preferred contrast promoting agents, which can be incorporated in the photographic element, include diarylcarbinol compounds as described in U.S. Pat. No. 4,777,118. Examples of diarylcarbinol contrast promoting agents are benz-hydrol, 4,4'-dimethoxydiphenylmethanol, 4,4'-dimethyldiphenylmethanol, 2,2'-dibromodiphenylmethanol, and the like.

Other contrast promoting agents useful for high contrast images are for examples the alkanolamine compounds comprising a hydroxyalkyl group of 2 to 10 carbon atoms and a mercapto compound, as described in U.S. Pat. No. 4,668,605 or certain trialkyl amines, monoalkyl-dialkanolamines or dialkylmonoalkanol amines, as described in U.S. Pat. No. 4,740,452. Useful contrast promoting agents also include certain amino compounds which function as incorporated booster described in U.S. Pat. No. 4,975,354. These amino compounds contain within their structure a group comprised of at least three repeating ethylenoxy units.

The amount of said contrast promoting agent is from about $10^{-4}$ to $10^{-1}$ mole per mole of silver, more preferably from about $10^{-3}$ to $5\times10^{-2}$ mole per mole of silver.

The silver halide emulsion layer includes negative acting surface latent image-type silver halide grains in reactive association with a hydrazine compound.

Preferably the hydrazine compound is incorporated into the photographic element, for example in a silver halide emulsion layer or in a hydrophilic colloidal layer, preferably a hydrophilic colloidal layer adjacent to the emulsion layer in which the effects of the hydrazine compound are desired. It can, of course, be present in the photographic element distributed between the emulsion and the hydrophilic colloidal layers, such as subbing layers, interlayers and protective layers.

Hydrazine compounds to be incorporated into the photographic element are those disclosed in GB 598,108 and in U.S. Pat. Nos. 2,419,974; 4,168,977; 4,323,643; 4,224,401; 4,272,614; 2,410,690; 4,166,742; 4,221,857; 4,237,214; 4,241,164; 4,243,739; 4,272,606; 4,311,871; 4,332,878; 4,337,634; 4,937,160 and 5,190,847 and in Research Disclosure No. 235, November 1983, Item 23510 "Development nucleation by hydrazine and hydrazine derivatives".

In particular, useful photographic elements which can be processed with the fixing composition of this invention for forming high contrast images contain silver halide emulsions that may be silver chloride, silver chloro-bromide, silver iodo-bromide, silver iodo-chloro-bromide or any mixture thereof. Generally, the iodide content of the silver halide emulsions is less than about 10% iodide moles, said content being based on the total silver halide. The silver halide emulsions are usually monodispersed or narrow grain size distribution emulsions, as described for examples in U.S. Pat. Nos. 4,166,742; 4,168,977; 4,224,401; 4,237,214; 4,241,164; 4,272,614 and 4,311,871. The silver halide emulsions may comprise a mixture of emulsions having different grain combinations, for example a combination of an emulsion having a mean grain size above 0.7 micrometers, as described in JP 57-58137 or a combination of two emulsions, both having a grain size below 0.4 micrometers, such as for example a first silver halide emulsion having a mean grain size of 0.1 to 0.4 micrometers and a second silver halide emulsion with particles having a mean grain volume lower than one half the particles of the first emulsion.

Silver halide photographic elements for X-ray exposures which can be processed in the fixing compositions of the present invention comprise a transparent film base, such as polyethyleneterephthalate and polyethylene-naphthalate film base, having on at least one of its sides, preferably on both its sides, a silver halide emulsion layer.

The silver halide grains in the radiographic emulsion may be regular grains having a regular crystal structure such as cubic, octahedral, and tetradecahedral, or a spherical or irregular crystal structure, or those having crystal defects such as twin planes, epitaxialisation, or those having a tabular form, or combinations thereof.

The term "cubic grains" according to the present invention is intended to include substantially cubic grains, that is, silver halide grains which are regular cubic grains bounded by crystallographic faces (100), or which may have rounded edges and/or vertices or small faces (111), or may even be nearly spherical when prepared in the presence of soluble iodides or strong ripening agents, such as ammonia. The silver halide grains may be of any required composition for forming a negative silver image, such as silver chloride, silver bromide, silver chlorobromide, silver bromoiodide, silver bromochloroiodide, and the like. Particularly good results are obtained with silver bromoiodide grains, preferably silver bromoiodide grains containing about 0.1 to 15% moles of iodide ions, more preferably about 0.5 to 10% moles of iodide ions and still preferably silver bromoiodide grains having average grain sizes in the range from 0.2 to 3 $\mu$m, more preferably from 0.4 to 1.5 $\mu$m. Preparation of silver halide emulsions comprising cubic silver halide grains is described, for example, in Research Disclosure, Vol. 176, December 1978, Item 17643, Vol. 184, August 1979, Item 18431 and Vol 308, December 1989, Item 308119.

Other silver halide emulsions for radiographic elements having highly desirable imaging characteristics are those which employ one or more light-sensitive tabular grain emulsions as disclosed in U.S. Pat. No. 4,425,425 and 4,425,426. The tabular silver halide grains contained in the silver halide emulsion layers have an average diameter to thickness ratio (often referred to in the art as aspect ratio) of at least 2:1, preferably 3:1 to 20:1, more preferably 3:1 to 10:1, and most preferably 3:1 to 8:1. Average diameters of the tabular silver halide grains range from about 0.3 $\mu$m to about 5 $\mu$m, preferably 0.5 $\mu$m to 3 $\mu$m, more preferably 0.8 $\mu$m to 1.5 $\mu$m. The tabular silver halide grains have a thickness of less than 0.4 $\mu$m, preferably less than 0.3 $\mu$m and more preferably less than 0.2 $\mu$m.

The tabular silver halide grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter to thickness ratio of each grain can be calculated, and the diameter to thickness ratios of all tabular grains can be averaged to obtain their average diameter to thickness ratio. By this definition the average diameter to thickness ratio is the average of individual tabular grain diameter to thickness ratios. In practice, it is simpler to obtain an average diameter and an average thickness of the tabular grains and to calculate the average diameter to thickness ratio as the ratio of these two averages. Whatever the method used may be, the average diameter to thickness ratios obtained do not differ greatly.

In the silver halide emulsion layer Containing tabular silver halide grains, at least 15%, preferably at least 25%, and, more preferably, at least 50% of the silver halide grains are tabular grains having an average diameter to thickness ratio of not less than 3:1. Each of the above proportions, "15%", "25%" and "50%" means the proportion of the total projected area of the tabular grains having an average diameter to thickness ratio of at least 3:1 and a thickness lower than 0.4 μm, as compared to the projected area of all of the silver halide grains in the layer.

As described above, commonly employed halogen compositions of the silver halide grains can be used. Typical silver halides include silver chloride, silver bromide, silver chloroiodide, silver bromoiodide, silver chlorobromoiodide and the like. However, silver bromide and silver bromoiodide are preferred silver halide compositions for tabular silver halide grains with silver bromoiodide compositions containing from 0 to 10 mol % silver iodide, preferably from 0.2 to 5 mol % silver iodide, and more preferably from 0.5 to 1.5 mol % silver iodide. The halogen composition of individual grains may be homogeneous or heterogeneous.

Silver halide emulsions containing tabular silver halide grains can be prepared by various processes known for the preparation of radiographic elements. Silver halide emulsions can be prepared by the acid process, neutral process or ammonia process, or in the presence of any other silver halide solvent. In the stage for the preparation, a soluble silver salt and a halogen salt can be reacted in accordance with the single jet process, double jet process, reverse mixing process or a combination process by adjusting the conditions in the grain formation, such as pH, pAg, temperature, form and scale of the reaction vessel, and the reaction method. A silver halide solvent, such as ammonia, thioethers, thioureas, etc., may be used, if desired, for controlling grain size, form of the grains, particle size distribution of the grains, and the grain-growth rate.

Preparation of silver halide emulsions containing tabular silver halide grains is described, for example, in de Cugnac and Chateau, "Evolution of the Morphology of Silver Bromide Crystals During Physical Ripening", Science and Industries Photographiques, Vol. 33, No.2 (1962), pp. 121–125, in Gutoff, "Nucleation and Growth Rates During the Precipitation of Silver Halide Photographic Emulsions", Photographic Science and Engineering, Vol. 14, No. 4 (1970), pp. 248–257, in Berry et al., "Effects of Environment on the Growth of Silver Bromide Microcrystals", Vol.5, No.6 (1961), pp. 332–336, in U.S. Pat. Nos. 4,063,951, 4,067,739, 4,184,878, 4,434,226, 4,414,310, 4,386,156, 4,414,306 and in EP Pat. Appln. No. 263,508.

In preparing the silver halide emulsions for photographic elements, a wide variety of hydrophilic dispersing agents for the silver halides can be employed. Gelatin is preferred, although other colloidal materials such as gelatin derivatives, colloidal albumin, cellulose derivatives or synthetic hydrophilic polymers can be used as known in the art. Other hydrophilic materials useful known in the art are described, for example, in Research Disclosure, Vol. 308, Item 308119, Section IX. The amount of gelatin employed in a radiographic element is such as to provide a total silver to gelatin ratio higher than 1 (expressed as grams of Ag/grams of gelatin). In particular the silver to gelatin ratio of the silver halide emulsion layers is in the range of from 1 to 1.5.

The radiographic element which can be fixed with the fixing composition of the present invention can be forehardened to provide a good resistance in rapid processing conducted in automatic processing machine without the use of hardeners in processing solutions. Examples of gelatin hardeners are aldehyde hardeners, such as formaldehyde, glutaraldehyde and the like, active halogen hardeners, such as 2,4-dichloro-6-hydroxy-1,3,5-triazine, 2-chloro-4,6-hydroxy-1,3,5-triazine and the like, active vinyl hardeners, such as bis-vinylsulfonyl-methane, 1,2-vinylsulfonyl-ethane, bis-vinylsulfonyl-methyl ether, 1,2-bis-vinylsulfonylethyl ether and the like, N-methylol hardeners, such as dimethylolurea, methyloldimethyl hydantoin and the like, and bi-,tri-,or tetra-vinylsulfonyl substituted organic hydroxy compounds, such as 1,3-bis-vinylsulfonyl-2-propanol and the like. Other useful gelatin hardeners may be found in Research Disclosure, Vol. 308, December 1989, Item 308119, Paragraph X.

The above described gelatin hardeners may be incorporated in the silver halide emulsion layer or in a layer of the silver halide radiographic element having a water-permeable relationship with the silver halide emulsion layer. Preferably, the gelatin hardeners are incorporated in the silver halide emulsion layer.

The amount of the above described gelatin hardener that is used in the silver halide emulsion of the radiographic element of this invention can be widely varied. Generally, the gelatin hardener is used in amounts of from 0.5% to 10% by weight of hydrophilic dispersing agent, such as the above described highly deionized gelatin, although a range of from 1% to 5% by weight of hydrophilic dispersing agent is preferred.

The gelatin hardeners can be added to the silver halide emulsion layer or other component layers of the radiographic element utilizing any of the well-known techniques in emulsion making. For example, they can be dissolved in either water or a water-miscible solvent such as methanol, ethanol, etc. and added into the coating composition for the above mentioned silver halide emulsion layer or auxiliary layers.

The silver halide emulsions can be chemically and optically sensitized by known methods.

Spectral sensitization can be performed with a variety of spectral sensitizing dyes known in the art. An example of such spectral sensitizing dyes is the polymethine dye class, including cyanines, complex cyanines, merocyanines, complex merocyanines, oxonols, hemioxonols, styryls, merostyryls and streptocyanines.

Although native UV-blue sensitivity of silver halides is usually known in the art, significant advantage can be obtained by the use of spectral sensitizing dyes, even when their principal absorption is in the spectral region to which the silver halide emulsion have their native sensitivity.

Preferably, spectral sensitizing dyes according to this invention are those which exhibit J aggregates if adsorbed on the surface of the silver halide grains and a sharp absorption band (J-band) with a bathocromic shift with respect to the absorption maximum of the free dye in aqueous solution. Spectral sensitizing dyes producing J aggregates are well known in the art, as illustrated by F. M. Hamer, *Cyanine Dyes and Related Compounds*, John Wiley and Sons, 1964, Chapter XVII and by T. H. James, *The Theory of the Photographic Process*, 4th edition, Macmillan, 1977, Chapter 8. The use of J-band exhibiting dyes allows the reduction of the well-known problem of crossover.

The silver halide emulsion layers can contain other constituents generally used in photographic products, such as binders, hardeners, surfactants, speed-increasing agents, stabilizers, plasticizers, gelatin extenders, optical sensitizers, dyes, ultraviolet absorbers, etc., and reference to such constituents can be found, for example, in Research Disclosure, Vol. 176, December 1978, Item 17643, Vol. 184, August 1979, Item 18431 and Vol 308, December 1989, Item 308119.

The photographic elements can be prepared by coating the light-sensitive silver halide emulsion layers and other auxiliary layers on a support. Examples of materials suitable for the preparation of the support include glass, paper, polyethylene-coated paper, metals, polymeric film such as cellulose nitrate, cellulose acetate, polystyrene, polyethylene terephthalate, polyethylene naphthalenate, polyethylene, polypropylene and other well known supports. Preferably, the silver halide emulsion layers are coated on the support at a total silver coverage of at least 1 g/m$^2$, preferably in the range of from 2 to 5 g/m$^2$.

Auxiliary layers can be represented by top-coating layers, antistatic layers, antihalo layer, protective layers, dye underlayers, and the like. Dye underlayers are particularly useful in order to reduce the cross-over of the double coated silver halide radiographic material. Reference to well-known dye underlayer can be found in U.S. Pat. No. 4,900,652, U.S. Pat. No. 4,855,221, U.S. Pat. No. 4,857,446, 4,803,150. According to a preferred embodiment, a dye underlayer is coated from at least one side of the support, more preferably on both sides of the support, before the coating of said at least two silver halide emulsions.

The radiographic element is associated with the intensifying screens so as to be exposed to the radiations emitted by said screens. The pair of screens employed in combination with the radiographic element is symmetrical or unsymmetrical. The screens are made of relatively thick phosphor layers which transform the X-rays into light radiation (e.g., visible light). The screens absorb a portion of X-rays much larger than the radiographic element and are used to reduce the radiation dose necessary to obtain a useful image.

The phosphors used in the intensifying screens have an emission maximum wavelength in the ultraviolet, blue, green, red or infrared region of the electromagnetic spectrum according to the region of the electromagnetic spectrum to which said at least two silver halide emulsion layers are sensitive. More preferably, said phosphors emit radiations in the ultraviolet, blue and green regions of the electromagnetic spectrum.

The green emitting phosphors emit radiation having more than about 80% of its spectral emission above 480 nm and its maximum of emission in the wavelength range of 530–570 nm. Green emitting phosphors which may be used in the intensifying screens include rare earth activated rare earth oxysulfide phosphors of at least one rare earth element selected from yttrium, lanthanum, gadolinium and lutetium, rare earth activated rare earth oxyhalide phosphors of the same rare earth elements, a phosphor composed of a borate of the above rare earth elements, a phosphor composed of a phosphate of the above rare earth elements and a phosphor composed of tantalate of the above rare earth elements. These rare earth green emitting phosphors have been extensively described in the patent literature, for example in U.S. Pat. Nos. 4,225,653, 3,418,246, 3,418,247, 3,725,704, 3,617,743, 3,974,389, 3,591,516, 3,607,770, 3,666,676, 3,795,814, 4,405,691, 4,311,487 and 4,387,141. These rare earth phosphors have a high X-ray absorbing power and high efficiency of light emission when excited with X radiation and enable radiologists to use substantially lower X radiation dosage levels.

The binder employed in the fluorescent layer of the intensifying screens can be, for example, one of the binders commonly used in forming layers: gum arabic, protein such as gelatin, polysaccharides such as dextran, organic polymer binders such as polyvinylbutyral, polyvinylacetate, nitrocellulose, ethylcellulose, vinylidenechloride-vinylchloride copolymer, polymethylmeth-acrylate, polybutylmethacrylate, vinylchloride-vinyl-acetate copolymer, polyurethane, cellulose acetate butyrate, polyvinyl alcohol, and the like.

Generally, the binder is used in an amount of 0.01 to 1 part by weight per one part by weight of the phosphor. However, from the viewpoint of the sensitivity and the sharpness of the screen obtained, the amount of the binder should preferably be small. Accordingly, in consideration of both the sensitivity and the sharpness of the screen and the easiness of application of the coating dispersion, the binder is preferably used in an amount of 0.03 to 0.2 parts by weight per one part by weight of the phosphor. The thickness of the fluorescent layer is generally within the range of 10 $\mu$m to 1 mm.

The following examples illustrate the present invention.

EXAMPLE 1

Ready-to-use fixer composition (Sample 1), as described in Japanese Patent Application 05-323,525, was prepared having the following composition:

| | | |
|---|---|---|
| Water up to | l | 1 |
| I-4 | g | 5 |
| Sodium Thiosulfate | g | 158 |
| Sodium Sulfite | g | 7 |
| Sodium Metabisulfite | g | 20 |
| Acetic Acid | g | 4 |
| pH | | 5.5 |

Samples 2–8 were prepared as fixer composition 1, with the addition of diphosphonic sequestering agent (II-4), aluminum sulfate hardening agent and ammonium acetate compound in the amounts as described in Table 1. In particular, Samples 2 and 3 contained the maximum amount (0.01 mol/l) of aluminum compound present in the fixer compositions according to said Japanese Patent Application 05,323,525. Sample 5 contained the maximum amount (0.1 mol/l) of ammonium ions present in the fixer composition according to the same Japanese Patent application.

Said samples were evaluated in view of the hardening activity, measured after development of a 3M radiographic XDA+ film in a 3M APS HQ developer, and in view of the precipitation of aluminum hydroxide. The results are also shown in Table 1. The hardness was measured 24 hours after the coating with a particular instrument provided with a stylus which engarves the sample imbibed with a liquid composition, water or processing solution, where it has been kept for a given temperature. The hardness values are expressed in grams loaded on the stylus to engarve the sample: the higher the weight, the harder the material.

TABLE 1

| Sample | Sequest. Agent (g) | Aluminum Sulfate (mol/l) | Ammonium Acetate (mol/l) | Evaluation of precipitation of aluminum | Hardening Activity |
|---|---|---|---|---|---|
| 1 (ref.) | 0 | 0 | 0 | clear solution | very bad |
| 2 (comp.) | 0 | 0.010 | 0 | cloudy liquid | bad |
| 3 (comp.) | 1.5 | 0.010 | 0 | clear solution | bad |
| 4 (comp.) | 1.5 | 0.026 | 0 | precipitation | good |
| 5 (comp.) | 1.5 | 0.026 | 0.10 | precipitation | good |
| 6 (inv.) | 1.5 | 0.026 | 0.25 | clear solution | good |
| 7 (inv.) | 1.5 | 0.026 | 0.50 | clear solution | good |

Even if samples 1 and 3 gave a clear solution, they were not useful for the aim of the present invention because they contained an amount of aluminum compound (0.01 mol/l or less) not sufficient to obtain a hardening activity. Samples 4 and 5 contained a sufficient amount of aluminum salt hardening agent to give a good hardening activity but produced a precipitate formation of aluminum hydroxide due to the fact that they did not contain a sufficient amount of ammonium ions (less than 0.20 mol/l). Fixing compositions 6 and 7, containing at least 0.20 mol/l of ammonium ions and at least 0.02 mol/l of aluminum salt hardening agent, were the only fixer compositions able to give a clear solution and a good hardening activity.

EXAMPLE 2

Ready-to-use fixer composition (Sample 8) was prepared having the following composition:

| | | |
|---|---|---|
| Water up to | l | 1.00 |
| Ammonium Thiosulfate | g | 145.2 |
| Sodium sulfite | g | 8.125 |
| Boric Acid | g | 7 |
| Ammonium Acetate | g | 19.24 |
| Acetic Acid | g | 7.52 |
| Aluminum Sulfate | g | 8.9 |
| Sulfuric Acid | g | 3.58 |
| pH | | 4.30 |

Samples 9 to 36 were prepared adding to the formulation of Sample 8 the aminopolycarboxylic acid sequestering agents (indicated as sequestering agent of type A) and the polyphosphonic acid sequestering agents (indicated as sequestering agent of type B) as indicated in Table 2, in an amount of 1.5 g for each sequestering agent. The pH of fixer compositions 9 to 36 was adjusted at 6.00 with the addition of KOH, said pH value being higher than the standard value of about 4.30–5.30 for fixer compositions, to simulate carry-in of the alkaline developer into the fixer.

TABLE 2

| Sample | Sequestering Agents type A | Sequestering Agents type B | Evaluation |
|---|---|---|---|
| 8 (ref.) | none | none | precipitate formation |
| 9 (comp.) | (I-4) | none | precipitate formation |
| 10 (comp.) | (I-5) | none | precipitate formation |
| 11 (comp.) | (I-6) | none | precipitate formation |
| 12 (comp.) | (A-1) | none | precipitate formation |
| 13 (comp.) | (A-2) | none | precipitate formation |
| 14 (comp.) | none | (II-18) | precipitate formation |
| 15 (comp.) | none | (II-12) | precipitate formation |
| 16 (comp.) | none | (II-4) | precipitate formation |
| 17 (comp.) | none | (II-1) | precipitate formation |
| 18 (comp.) | (I-4) + (A-2) | none | precipitate formation |
| 19 (comp.) | (I-4) + (A-1) | none | precipitate formation |
| 20 (comp.) | (A-1) + (A-2) | none | precipitate formation |
| 21 (comp.) | none | (II-18) + (II-12) | precipitate formation |
| 22 (comp.) | none | (II-18) + (II-4) | precipitate formation |
| 23 (comp.) | none | (II-18) + (II-1) | precipitate formation |
| 24 (comp.) | none | (II-12) + (II-1) | precipitate formation |
| 25 (comp.) | none | (II-4) + (II-1) | precipitate formation |
| 26 (inv.) | (I-4) | (II-18) | clear solution |
| 27 (inv.) | (I-4) | (II-12) | clear solution |
| 28 (inv.) | (I-4) | (II-4) | clear solution |
| 29 (inv.) | (I-5) | (II-18) | clear solution |
| 30 (inv.) | (I-5) | (II-4) | clear solution |
| 31 (inv.) | (I-6) | (II-18) | clear solution |
| 32 (inv.) | (I-6) | (II-4) | clear solution |
| 33 (comp.) | (A-1) | (II-4) | cloudy liquid |
| 34 (comp.) | (A-2) | (II-4) | cloudy liquid |
| 35 (comp.) | (A-3) | (II-4) | cloudy liquid |
| 36 (comp.) | (A-4) | (II-4) | cloudy liquid |

Table 2 shows that only the fixer compositions (26–32) containing a composition of a polyaminocarboxylic acid sequestering agent of formula (I) of the present invention with a polyphosphonic acid sequestering agent of formula (II) of the present invention are able to keep the fixer solution clear. In fact, the fixer compositions 9–13 and 18–20, containing one or more polyaminocarboxylic acid sequestering agents without polyphosphonic acid sequestering agent, the fixer compositions 14–17 and 21–25, containing one or more polyphosphonic acid sequestering agents without polyaminocarboxylic acid sequestering agents, and the fixer compositions 33–36, containing polyphosphonic acid sequestering agents of formula (II) of the present invention with a comparison polyaminocarboxylic acid sequestering agent not belonging to the formula (I) of the present invention, are not able to keep the solution clear, forming a precipitation.

The $SO_2$ emission from fixer compositions was analytically evaluated, following the method described in "Supplemento ordinario alla Gazzetta Ufficiale Italiana" No. 59, Mar. 8, 1971. The method consisted in conveying fumes coming from the fixer solutions into a solution containing $H_2O_2$ and then analyzing the concentration of $SO_3(H_2SO_4)$ in the solution by an acid-base tritation. Then, the content of $SO_2$ in fumes was easily determined. The results, showed in Table 3, are expressed as percentage in volume and then converted in parts per milion.

TABLE 3

| Sample | $SO_2$ Emission | Comments |
|---|---|---|
| 8 (ref.) | $61 \times 10^{-3}$ | Very bad |
| 28 (inv.) | $25 \times 10^{-3}$ | Good |

Comparison sequestering agents:

(A-1)

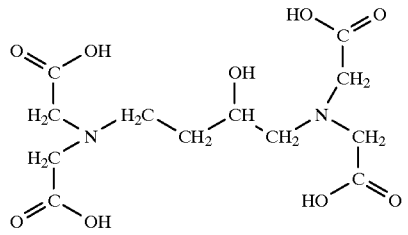

(A-1)

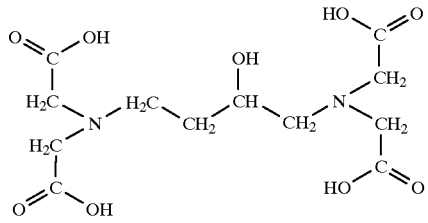

(A-2)

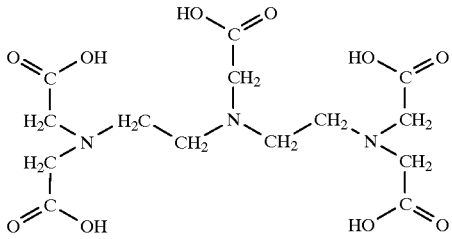

-continued (A-3)

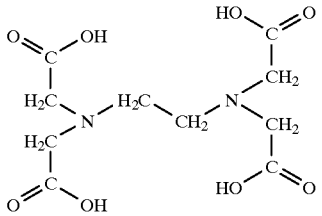

(A-4)

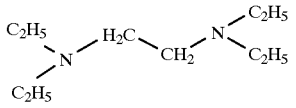

We claim:

1. A hardening black and white photographic fixer composition comprising a thiosulfate silver halide solvent, an aluminum salt hardening agent in an amount of at least 0.02 mol/L, a buffering agent and ammonium ions in an amount of at least 0.20 mol/L, wherein said fixer composition also contains at least 0.05 mol per mole of hardening agent of an aminopolycarboxylic acid sequestering agent of formula (I-a) or (I-b) or a water-soluble salt thereof and at least 0.05 mol per mole of hardening agent of a polyphosphonic acid sequestering agent of formula (II-a), (II-b), (II-c), (II-d') or (II-d"):

(I-a)

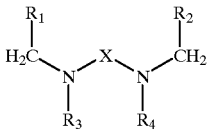

(I-b)

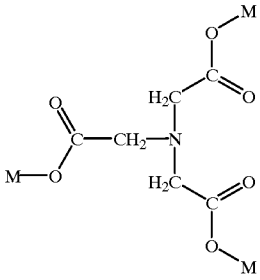

wherein X is an unsubstituted alkylene group having 1 to 4 carbon atoms; $R_3$ and $R_4$, equal or different, each represent hydrogen or —$CH_2$—$R_1$ and $R_1$ and $R_2$, equal or different, each represent —COOM, wherein M represents a hydrogen atom, a sodium atom, a potassium atom, a lithium atom, or an ammonium group;

(II-a)

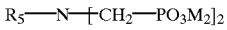

wherein M is as above and $R_5$ is an alkyl group, an aryl group, an aralkyl group, an alkaryl group, an alicyclic group or a heterocyclic group;

(II-b)

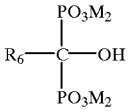

wherein M is as above and $R_6$ is an alkyl group, (II-c)

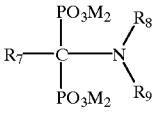

wherein M is as above and $R_7$, $R_8$ and $R_9$ are hydrogen or an alkyl group, and (II-d')

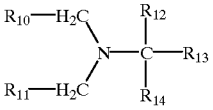

or (II-d")

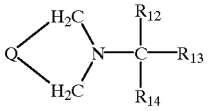

wherein $R_{12}$, $R_{13}$ and $R_{14}$, equal or different, each represent a hydrogen atom or a —$PO_3M_2$ group, wherein M has the same meaning as above, and $R_{10}$ and $R_{11}$, equal or different, each represent a hydrogen atom, an alkyl group, a —$PO_3M_2$ group or a —$PO_3M_2$ substituted alkyl group, and Q: represents the atoms or chemical bonds necessary to complete a 3- to 6-membered ring, with the proviso that at least two of $R_{10}$, $R_{11}$, $R_{12}$, $R_{13}$ and $R_{14}$ substituents represent a —$PO_3M_2$ group, and wherein said fixer composition has a pH in the range from 4.75 to 6.25.

2. Photographic fixer compositions of claim 1, wherein the aminopolycarboxylic acid sequestering agent is of the ethylene diaminotetraacetic acid type.

3. Photographic fixer compositions of claim 1, wherein the aminopolycarboxylic acid sequestering agent is of the ethylene diaminodiacetic acid type.

4. Photographic fixer compositions of claim 1, wherein the aminopolycarboxylic acid sequestering agent is of the nitrilotriacetic acid type.

5. Photographic fixer compositions of claim 1, wherein the polyphosphonic acid sequestering agent corresponds to the formula:

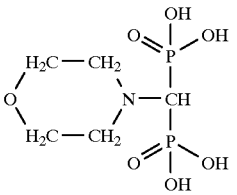

6. Photographic fixer compositions of claim 1, wherein the polyphosphonic acid sequestering agent corresponds to the formula:

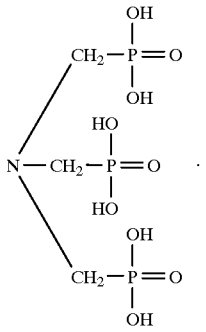

7. Photographic fixer compositions of claim 1, wherein the polyphosphonic acid sequestering agent corresponds to the formula:

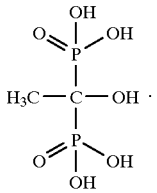

8. Photographic fixer compositions of claim 1, wherein the polyphosphonic acid sequestering agent corresponds to the formula:

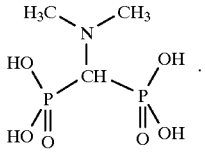

9. Photographic fixer compositions of claim 1, wherein the amount of the aminopolycarboxylic acid sequestering agent is at least 0.1 mol per 1 mole of the hardening agent.

10. Photographic fixer compositions of claim 1, wherein the amount of the polyphosphonic acid sequestering agent is at least 0.1 mol per 1 mole of the hardening agent.

11. Photographic fixer compositions of claim 1, wherein said aluminum salt hardening agent is chosen among aluminum chloride, aluminum sulfate and potassium or ammonium aluminum.

12. Photographic fixer compositions of claim 1, wherein said buffering agent is ammonium acetate.

13. Photographic fixer compositions of claim 1 containing ammonium ions in an amount of about 0.30 mol/l.

14. Process for treating an exposed photographic silver halide element comprising the steps of developing by means of a developer comprising a silver halide developing agent and treating the developed element with the hardening black and white fixer composition of claim 1.

* * * * *